US005086303A

United States Patent [19]

Usui et al.

[11] Patent Number: 5,086,303

[45] Date of Patent: Feb. 4, 1992

[54] PRIMARY FEED WITH CENTRAL CONDUCTOR DEFINING A DISCHARGE PATH

[75] Inventors: Ikuro Usui, Hiratsuka; Hirokazu Ohgi; Kazuhisa Ogawa, both of Yokohama, all of Japan

[73] Assignee: The Agency of Industrial Science and Technology, Tokyo, Japan

[21] Appl. No.: 309,410

[22] Filed: Feb. 13, 1989

[30] Foreign Application Priority Data

Feb. 19, 1988 [JP] Japan ..... 63-35338

[51] Int. Cl.[5] ..... H01Q 13/02; H01Q 19/13

[52] U.S. Cl. ..... 343/756; 343/781 P; 343/786

[58] Field of Search ..... 343/781 R, 840, 786, 343/781 P, 781 CA, 756; 333/21 R, 21 A

[56] References Cited

U.S. PATENT DOCUMENTS

| | | | |
|---|---|---|---|
| 2,605,416 | 7/1952 | Foster | 343/781 P |
| 2,698,901 | 1/1955 | Wilkes | 343/781 P |
| 3,581,311 | 5/1971 | Kach | 343/781 |
| 4,178,576 | 12/1979 | Schmidt et al. | 343/781 R |

FOREIGN PATENT DOCUMENTS

| | | | |
|---|---|---|---|
| 2342904 | 4/1975 | Fed. Rep. of Germany | 343/781 CA |
| 1198026 | 12/1959 | France | 343/756 |
| 52-24449 | 2/1977 | Japan | 343/756 |

*Primary Examiner*—Michael C. Wimer

*Attorney, Agent, or Firm*—Antonelli, Terry, Stout & Kraus

[57] ABSTRACT

A primary radiator is provided which can be used in an attenna to be mounted in an artificial satellite. In particular, the primary radiator is designed to prevent an electrical charge caused by charged particles in a space environment. In the conventional type of radiator, there typically has been no arrangement for preventing such electrical charge which may cause a short-circuited condition resulting in providing noise or communication difficulties. In order to prevent this electrical charging, a fine metallic conductor is passed from the central part of a sub-reflector through an axial central part where an influence for the electromagnetic field is minimal within the circular waveguide constituting the primary radiator. The conductor is then connected to ground in a DC form at a rectangular and circular converter of the primary radiator. With such a construction, since the metallic conductor is crossed at a right angle with an electric field of a dominant mode for transmitting within the waveguide, less disturbance of electromagnetic field is found, and further the metallic conductor may act to prevent the electrical charging.

11 Claims, 3 Drawing Sheets

FIG. 1A
FIG. 1B
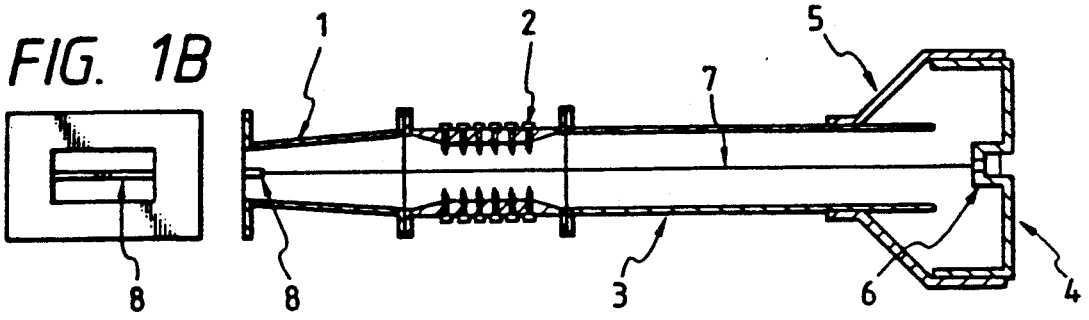
FIG. 2
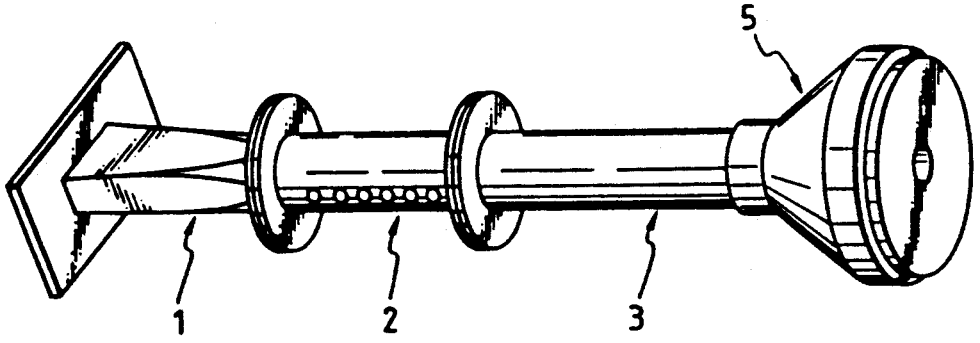

PRIMARY FEED WITH CENTRAL CONDUCTOR DEFINING A DISCHARGE PATH

BACKGROUND OF THE INVENTION

1. Field of the Invention

This invention relates to a primary radiator which is a component element of an antenna to be mounted in an artificial satellite, and, more particularly to a structure of a primary radiator for preventing an electrical charge caused by charged particles and the like found in the environment of space.

2. Description of the Prior Art .

Conventional self-independent primary radiators are typically constructed such that a cap-like sub-reflection part is fixed to an opening of an electrical supplying waveguide, with an insulator formed of resin material which permits good penetration of electromagnetic waves being used for fixing the sub-reflector. In such devices there has typically been no arrangement for providing DC conduction between the sub-reflector and the electrical supplying waveguide.

In a case where the above-described primary radiator is mounted in a satellite and used in space, since there is no DC conduction between the sub-reflector and the electrical supplying waveguide, charged particles tend to accumulate at the sub-reflector under a mutual action with plasma faced on an orbit of the satellite. Because of this, an electrical potential difference generated between both elements is increased to cause a discharged short circuit or some similar problem.

Such a discharged short circuit as above has some significant disadvantages in that it becomes a source of noise which can adversely affect the operation of the communication system in the satellite.

SUMMARY OF THE INVENTION

An object of the present invention is to provide a self-independent type primary radiator of an electrical supplying waveguide to be operated by a circular polarization wave having a countermeasure against an electrical charge of the above-described charged particles.

The above-described object is accomplished by passing a fine metallic conductor from a central part of a sub-reflector to an axial central part where less influence is applied to an electromagnetic field within a circular waveguide propagating transmittance mode TE11 constituting the self-independent primary radiator, and then connecting the conductor to a ground in DC form at a linear polarization part of a rectangular and circular converter.

As a method for making an electrical conduction between the sub-reflector and the electrical supplying waveguide, it would be easy to arrange the metallic conductor along a cover. However, such a method can not be satisfactorily employed in an antenna where a non-symmetrical characteristic of directivity is high due to the fact that this high-non-symmetrical characteristic appears in an opening surface type antenna radiating a circular polarization. In turn, since the axial central part in the circular waveguide is crossed at a right angle with an electric field of a dominant mode to be transmitted, the fine metallic conductor may restrict a disturbance of the electromagnetic field even if the conductor is fixed within the waveguide.

Accordingly, if the fine metallic conductor is passed from the central part of the sub-reflector to the axial central part in the circular waveguide and connected to a ground in DC form at the part of the linear polarization of the rectangular and circular converter, it becomes possible provide operation with a circular polarization wave and to make an electrical conduction between the sub-reflector and the electrical supplying waveguide without applying any substantial influence over a directivity of the primary radiator or V.S.W.R.

According to the present invention, the mechanism for preventing an electrical charge disturbance is not realized by sacrificing an electrical characteristic of the primary radiator, but by use of a basic design configuration of the conventional type of primary radiator with some additional component parts applied to the primary radiator as well as with some additional machining. This results in enabling a new function for providing a countermeasure for preventing an electrical charge disturbance without adversely influencing the electrical characteristic.

BRIEF DESCRIPTION OF THE DRAWINGS

FIG. 1A and FIG. 1B are sectional views for showing a preferred embodiment of the self-independent type radiator of the present invention.

FIG. 2 is a perspective view of outer surface of the embodiment shown in FIG. 1A.

DETAILED DESCRIPTION

Preferred Embodiments

Figure 3:
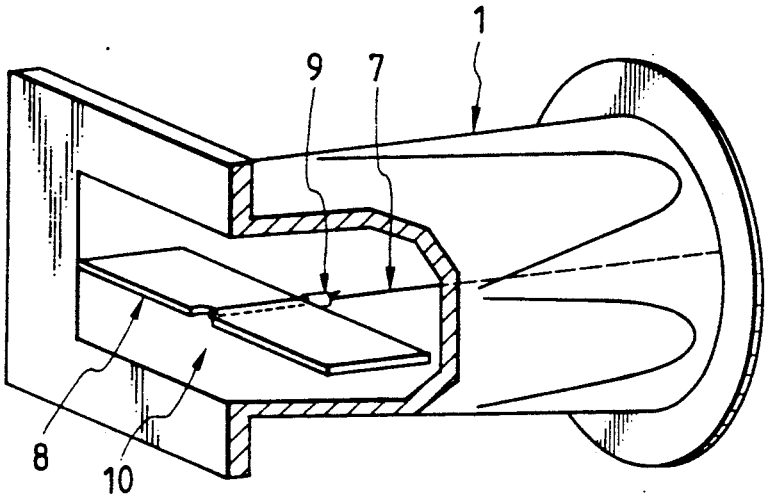
FIG. 3 is a perspective view for showing an assembled condition of the metallic wire of the present invention within rectangular and circular converter from FIG. 1A with a part of the waveguide being broken away.

One preferred embodiment of the present invention will now be described with reference to the accompanying drawings.

FIG. 1A is a sectional views for showing a self-independent type primary radiator assembled with a metallic conductor for preventing an electrical charging action, and FIG. 2 is an outer appearance view for showing the primary radiator of the present invention. FIG. 1B shows an end view of the structure.

As illustrated in the preferred embodiment of the present invention, the self-independent type primary radiator of the present invention is comprised of a rectangular and circular converter 1 for converting a transmittance mode TE10 of the rectangular waveguide into a transmittance mode TE11 of the circular waveguide, a circular polarization generator 2 for converting a linear polarization into a circular polarization and a horn 3 for radiating the wave outwardly. The horn part fixes a cap-like sub-reflection part 4 to an opening part of the electrical supplying waveguide through a resin cover 5. A reference numeral 6 denotes an aligner for performing an impedance alignment with the circular waveguide fixed so as to provide an efficient radiation from the sub-reflection part in an outward direction.

In this self-independent type primary radiator, a fine metallic wire 7 for use in preventing an electrical charging is passed and arranged through an axial central part where less influence is applied to the electromagnetic fields in the circular waveguide, the circular polarization generator 2 and the rectangular and circular converter 1 and then fixed to an interior part of the rectangular and circular converter 1 through a short circuit plate 8.

In case the antenna is to be used in space, a surplus amount of local charged particles generated at the sub-reflector 4 can be transmitted along an electrical discharging path of this metallic wire 7 formed in the primary radiator and flow into the main body of the antenna, so that both the sub-reflector 4 and the main body of the antenna can be kept substantially at an identical potential.

The short-circuit plate 8 within the rectangular and circular converter 1 is fixed in a direction crossing at a right angle with the polarization plane of the linear polarization in such a way that any adverse influence on the electromagnetic field can be kept low.

In addition, if a diameter of the metallic wire is made to have a value less than 1/100λ (λ: a wave length), less influence over the transmittance mode TE11 of the circular waveguide is found, so that it is possible to make the influence over V.S.W.R. or a directivity as one which shows practically less problems in case the device is constructed as a primary radiator operating at a circular polarization.

Figure 4:
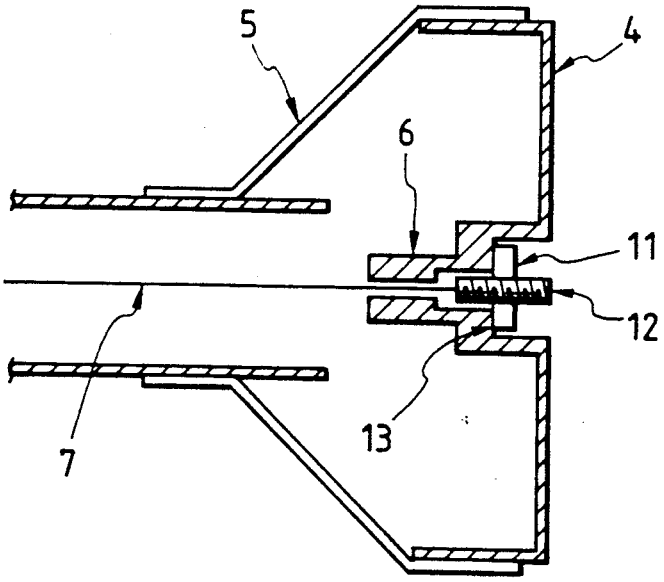
FIG. 4 is a sectional view for showing a condition in which the metallic wire of the present invention is fixed to the sub-reflector from FIG. 1A.

FIG. 3 and 4 show one preferred embodiment in which the metallic wire for preventing electrical charging is assembled in the self-independent type primary radiator.

More specifically, FIG. 3 is a perspective view in which a condition having the metallic wire 7 assembled in the rectangular and circular converter 1 is illustrated with a part of the waveguide being partly cut away.

The metallic wire 7 is wound around the short circuit plate 8 in the rectangular and circular converter and fixed in it. As a fixing means for this metallic wire, a press fitting at 9 is utilized, wherein two metallic wires to be wound around the short circuit plate 8 are passed through a fine metallic pipe and then the metallic pipe is crushed to form the press fitting 9 for fixing the wires.

In order to prevent the wound metallic wire from being moved on the short circuit plate, a small groove 10 is made at the part where the wire is wound. The short circuit plate 8 is directed in a direction crossing at a right angle with a polarization plane of the linear polarization transmitted within the central part of the rectangular and circular converter 1, so that the electromagnetic field can pass without being influenced by the short circuit plate 8.

FIG. 4 is a sectional view for showing a condition in which the metallic wire is fixed at the cap-like sub-reflector 4.

More specifically, as shown in FIG. 4, the metallic wire 7 is passed from the central part of the sub-reflector 4 through the axial central part of the primary radiator. A terminal end of the metallic wire 7 is fixed with a metallic threaded column 12 for fitting a nut 11 with a press contact arrangement.

The sub-reflector is also provided with a block 13 for fixing the metallic column 12 together with the nut 11, and the metallic wire 7 is fixed to the block 13 under a tensioned condition with the nut 11. In addition, if, as a material quality of the metallic wire 7, twisted metallic wires of tens to several tens elements are employed, it is possible to improve the mechanical strength and reliability of the arrangement.

Figure 5:
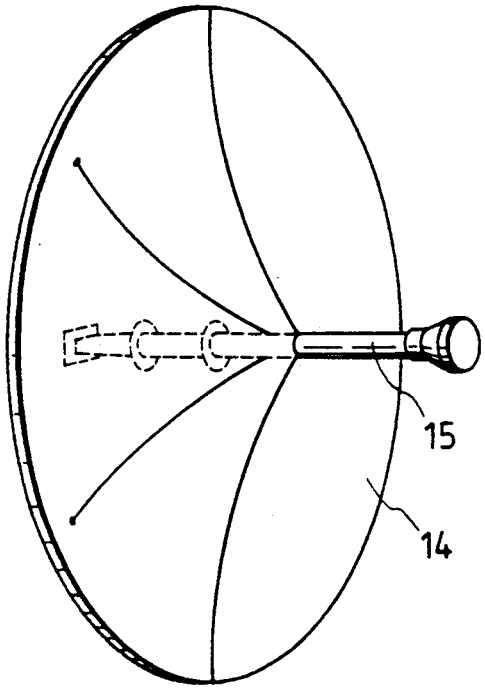
FIG. 5 is an outer appearance view for showing a preferred embodiment of the opening surface antenna of the present invention using the primary radiator shown in FIG. 1A.
Figure 6:
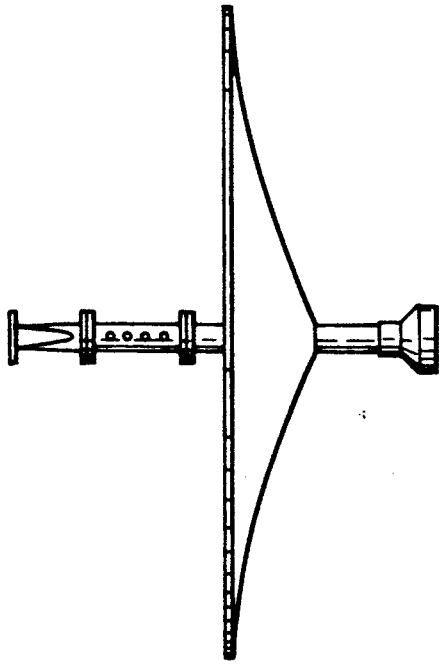
FIG. 6 is a side elevational view for showing a preferred embodiment of the opening surface antenna of the present invention.

FIG. 5 and 6 illustrate a preferred embodiment of the opening surface antenna constructed with the primary radiator of the present invention, wherein FIG. 5 is an outer appearance and FIG. 6 is a side elevational view. A reference numeral 14 designates a main reflection mirror and a reference number 15 denotes a primary radiator. An electromagnetic wave rediated from the primary radiator is reflected by the main reflection mirror and then radiated outwardly.

The preferred embodiment of the present invention can be mounted on an inspecting satellite, and this embodiment corresponds to the preferred embodiment of the opening surface antenna for radiating a broad beam where the main reflection mirror has a conical special shape.

We claim:

1. A primary radiator of a self-independent type operated with a circular polarization wave comprising:

a converter including means for converting a first predetermined transmittance mode signal into a second predetermined transmittance mode signal;

a circular polarization generator coupled to receive said second predetermined transmittance mode signal from said converter and including means for converting a linear polarization of said second predetermined transmittance mode signal into a circular polarization to provide a circular polarization wave;

a circular waveguide horn having a first end coupled to receive the circular polarization wave of said circular polarization generator and having a second end coupled to sub-reflection means for radiating an output signal from said circular waveguide horn in an outward direction from said sub-reflection means; and a conductor coupled between said sub-reflection means and said converter to extend along a central axis through said converter, said circular polarization generator, said circular waveguide horn, and said sub-reflection means to provide a discharge path along said central axis from said sub-reflection means for local charged particles generated at said sub-reflection means without adversely influencing an electromagnetic field within the primary radiator, wherein said conductor is connected to said converter by a short circuit plate.

2. A primary radiator according to claim 1, wherein said converter is a rectangular to circular converter.

3. A primary radiator according to claim 2, wherein said first predetermined transmittance mode signal is a TE10 mode signal and said second predetermined transmittance mode signal is a TE11 mode signal.

4. A primary radiator according to claim 1, wherein said short circuit plate is arranged to extend in a direction to intersect the central axis, which direction is at a right angle with a polarization plane of a linear polarization transmitted within the converter.

5. A primary radiator according to claim 1, wherein said sub-reflection means is coupled to said circular waveguide horn by an insulating cover.

6. A primary radiator according to claim 1, wherein said primary radiator is coupled to a main reflection mirror to form an opening surface antenna.

7. A primary radiator according to claim 1, wherein said conductor is a metallic wire.

8. A primary radiator according to claim 1, wherein said conductor is comprised of a plurality of twisted metallic wires.

9. A primary radiator of a self-independent type operated with a circular polarization wave and coupled with a main reflection mirror to form an opening surface antenna, said primary radiator comprising:

a rectangular to circular converter including means for converting a transmittance mode TE10 signal into a transmittance mode TE11 signal;

a circular polarization generator coupled to receive said transmittance mode TE11 signal from said converter and including means for converting a linear polarization of said transmittance mode TE11 signal into a circular polarization to provide a circular polarization wave;

a circular waveguide horn having a first end coupled to receive the circular polarization wave of said circular polarization generator and having a second end coupled to sub-reflection means for radiating an output signal from said circular waveguide horn in an outward direction from said sub-reflection means; and a conductor coupled between said sub-reflection means and said converter to extend along a central axis through said converter, said circular polarization generator, said circular waveguide horn, and said sub-reflection means to provide a discharge path along said central axis from said sub-reflection means for local charged particles generated at said sub-reflection means with adversely influencing an electromagnetic field within the primary radiator, wherein said conductor is connected to said converter through a short circuit plate which is arranged to extend in a direction to intersect the central axis, which direction is at a right angle with a polarization plane of a linear polarization transmitted within the converter.

10. A primary radiator according to claim 9, wherein said conductor is a metallic wire.

11. A primary radiator according to claim 9, wherein said conductor is comprised of a plurality of twisted metallic wires.

* * * * *